US005181972A

United States Patent [19]

Komatsubara et al.

[11] Patent Number: 5,181,972

[45] Date of Patent: Jan. 26, 1993

[54] PROCESS FOR PRODUCING GRAIN ORIENTED SILICON STEEL SHEETS HAVING EXCELLENT MAGNETIC PROPERTIES

[75] Inventors: Michiro Komatsubara; Mitsumasa Kurosawa; Yasuyuki Hayakawa, all of Chiba; Yoshiaki Iida, Kobe; Toshio Sadayori, Chiba, all of Japan

[73] Assignee: Kawasaki Steel Corporation, Japan

[21] Appl. No.: 635,511

[22] PCT Filed: May 15, 1990

[86] PCT No.: PCT/JP90/00609

§ 371 Date: Jan. 9, 1991

§ 102(e) Date: Jan. 9, 1991

[87] PCT Pub. No.: WO90/14445

PCT Pub. Date: Nov. 29, 1990

[30] Foreign Application Priority Data

May 15, 1989 [JP] Japan ..... 1-120956
Jun. 15, 1989 [JP] Japan ..... 1-150534

[51] Int. Cl.[5] ..... H01F 1/04
[52] U.S. Cl. ..... 148/111; 148/113
[58] Field of Search ..... 148/111, 113

[56] References Cited

U.S. PATENT DOCUMENTS 4,482,397 11/1984 Datta ..... 148/111
4,824,493 4/1989 Yoshitomi et al. ..... 148/111

FOREIGN PATENT DOCUMENTS 58-25425 2/1983 Japan .
61-127819 6/1986 Japan .
62-202624 9/1987 Japan .
63-100127 5/1988 Japan .
1-215925 8/1989 Japan .

*Primary Examiner*—John P. Sheehan
*Attorney, Agent, or Firm*—Austin R. Miller

[57] ABSTRACT

The present invention realizes the stable production of grain oriented silicon steel sheets having excellent magnetic properties under high productivity through effectively combining aging treatment with tandem rolling, in which cold rolling is effected until a final thickness is attained. In the final cold rolling step of the production of the grain oriented silicon steel sheets, the tandem rolling is first effected, and then continuous heat treatment is effected, preferably under application of tension.

5 Claims, 1 Drawing Sheet

PROCESS FOR PRODUCING GRAIN ORIENTED SILICON STEEL SHEETS HAVING EXCELLENT MAGNETIC PROPERTIES

TECHNICAL FIELD

This invention relates to a process for producing grain oriented silicon steel sheets having excellent magnetic properties In particular, the invention is aimed at enhancing productivity and further improving the magnetic properties by modifying a cold rolling step.

BACKGROUND TECHNIQUES

The grain oriented silicon steel sheets are required to have high magnetic flux density and a low iron loss as magnetic properties. With recent progress in production techniques, for example, 0.23 mm thick steel sheets having a magnetic flux density $B_8$ (value at 800 A/m of magnetizing forces) being 1.92 T are obtained, and products having excellent iron loss property $W_{17/50}$ (value at the maximum magnetization of 1.7 T under 50 Hz) being 0.90 W/kg can be produced in an industrial scale.

The materials having such excellent magnetic properties comprise crystalline structure in which <001> orientation as an axis of easy magnetization of iron is highly arrayed in a rolling direction of the steel sheet. A texture of such a crystalline structure is formed by a phenomenon called secondary recrystallization in which crystalline grains having (110)[001]called Goss orientation preferentially vigorously grow during final finish annealing in the production of the grain oriented silicon steel sheets. As a fundamental factor required to sufficiently grow these secondary recrystallized grains having the (110)[001]orientation, it is a well known fact that an inhibitor must be present to control growth of crystalline grains having unfavorable orientations other than the (110)[001]orientation during the secondary recrystallization step, and that the primary recrystallized structure is present for favorably sufficiently growing the secondary recrystallized grains having the (110)[001]orientation.

In general, a finely precipitatable material of MnS, MnSe, AlN or the like is used as an inhibitor. Further, it is common practice that effects of the 0 inhibitor are strengthened by adding a grain boundary segregatable type element such as Sb, Sn or the like together in combination as disclosed in Japanese patent publications Nos. 51-13,469 or 54-32,412.

On the other hand, in order to form an appropriate primary recrystallized structure, various countermeasures have heretofore been taken in each of hot rolling and cold rolling. For example, as to the strongly cold rolling using AlN as inhibitor, it is considered particularly effective to impart thermal effects at the time of warm rolling or cold rolling such as interpass aging as disclosed in Japanese patent publication Nos. 50-26,493, 54-13,846 and 54-29,182. This technique is to form a favorable texture by changing the deforming mechanism of the materials on rolling through utilization of interaction among dislocation and N and C as elements solid-solved in steel.

However, it is hard to say that the above prior art techniques are advantageous processes in view of the productivity. Moreover, good magnetic properties cannot always be stably obtained by these techniques. For example, the processes are technically difficult to carry out on an industrial scale in the case of warm rolling. On the other hand, interpass aging is ordinarily effected by thermally treating the coiled steel sheet at the number of plural times with using a reversing mill having one stand. The reason is that the steel sheet cannot uniformly thermally be treated over the entire coil length in the coiled state.

Incidentally, in order to enhance productivity, techniques using tandem mills comprising a plurality of stands have recently become the main trend. Different from the reversing mill, proportions of the draft among the passes must match with the rolling speed in the case of the rolling by using the tandem mill. Consequently, the deformation is naturally mainly compression deformation rather than tension deformation. Therefore, since the deformation mechanism in the rolling greatly differs from that in the prior art techniques, no satisfactory effect can be obtained by conventional aging treatment. This is a barrier in the case of tandem-rolling silicon steel sheets having high magnetic flux density and containing Al. In addition, repeated aging treatment conspicuously deteriorates productivity in view of the character of the tandem rolling. Therefore, there remains a problem in that aging cannot be effected at the number of plural times unlike the prior art techniques to enhance the aging effects.

DISCLOSURE OF THE INVENTION

This invention is to advantageously solve the above-mentioned problems, and to provide a novel process for producing grain oriented silicon steel sheets, which can stably improve magnetic properties even when productivity is enhanced by using the tandem mill.

In order both to more stably improve the magnetic stability and to greatly enhance the productivity, the present inventors have made various investigations. As a result, they found that even when the steel sheet cold rolled by the tandem mill was aged once, the grain oriented steel sheets having excellent magnetic properties can stably be produced.

The present invention has been accomplished based on the above knowledge.

That is, the present invention relates to the process for producing grain oriented steel sheets, comprising a series of steps of hot rolling a raw material for the grain oriented steel, cold rolling, once or twice, the resultant cold rolled sheet including intermediate annealing, applying an annealing separator to the cold rolled sheet after decarburization annealing, and subjecting it to a final finish annealing, characterized in that in a final cold rolling, the steel sheet is first cold rolled at a draft of 30–70% by tandem rolling, and is continuously thermally treated in a temperature range of 200° to 400° C. under application of tension of not less than 0.2 $kg/mm^2$ for 10 seconds to 10 minutes, and subsequently cold rolled to a final thickness.

In this invention, when the quality of the steel sheet differs in a coil-longitudinal direction before the final cold rolling, the temperature in the continuous thermal treatment after the tandem rolling is preferably continuously varied in the coil-longitudinal direction depending upon the difference in quality.

When the thermal treatment is continuously effected in such a low temperature range, hot air blast is preferably used as a heating means.

Further, according to the present invention, when the raw material for the grain oriented steel sheet contains AlN as a main inhibitor, the draft in the tandem rolling is preferably 35 to 70%.

On the other hand, when the raw material for the grain oriented steel sheet contains MnS and/or MnSe as the main inhibitor, the draft in the tandem rolling is preferably 30 to 50%.

The main inhibitor referred to above means an inhibitor for a second dispersion phase necessary for provoking a secondary recrystallizing phenomenon after the cold rolling step. However, this does not necessarily reject combined use of other secondary dispersion phase or a segregation type auxiliary inhibitor such as Sb, Te, Bi, Si or the like.

In the following, the present invention will be concretely explained based on experimental results giving rise to the invention.

A raw material for a grain oriented steel sheet consisting of 0.065 wt% (hereinafter referred to briefly as "%") of C, 3.25% of SI, 0.068% of Mn, 0.004% of P, 0.025% of S, 0.025% of sol Al, 0.008% of N and the balance being substantially Fe was heated at high temperatures, and was converted to a hot band of 2.2 mm in thickness by ordinary hot rolling. Then, after the pickling, the hot band was cold rolled to an intermediate thickness of 1.5 mm, and subjected to intermediate annealing at 1,100° C. for one minute and quenching to precipitate AlN.

A. Comparison between tandem rolling and Sendzimir rolling

Rolling was effected to attain the thickness of 0.23 mm with respect to a finally finished sheet, while aging was effected on the way.

(Aging once)

A steel sheet was formed by three time pass rolling with a Sendzimir mill or by rolling with a three stand tandem mill. In each case, the steel sheet was rolled to 0.60 mm, followed by aging and subsequent rolling with the mill.

(Aging twice)

A steel sheet was similarly rolled with the Sendzimir mill or the tandem mill, while it was aged on the way at the thicknesses of 1.0 mm and 0.60 mm. The steel sheet was subsequently rolled to a final thickness of 0.23 mm.

(Aging three times)

A steel sheet was similarly rolled with the Sendzimir mill or the tandem mill, while it was aged on the way at the thickness of 1.0 mm, 0.60 mm and 0.40 mm. The steel sheet was subsequently rolled to a final thickness of 0.23 mm.

Each of the above aging treatments was effected at 300° C. for 2 minutes.

The thus obtained steel sheet was subjected to decarburization annealing at 840° C. for 2 minutes in wet hydrogen, and later the steel sheet was coated with an annealing separator consisting mainly of MgO, and was then finally annealed.

The magnetic properties are shown in Table 1.

TABLE 1

| Rolling way | Magnetic property | Number of times of aging: Once | Twice | Three times |
|---|---|---|---|---|
| Sendzimir | $B_8$ (T) | 1.893 | 1.900 | 1.904 |
| | $B_{17/50}$ (W/kg) | 1.05 | 1.02 | 1.01 |
| Tandem | $B_8$ (T) | 1.876 | 1.865 | 1.871 |
| | $B_{17/50}$ (W/kg) | 1.13 | 1.19 | 1.15 |

As anticipated, it is seen in the results of Table 1 that effects of improving the magnetic properties by the aging treatment in the tandem rolling are smaller, and far inferior as compared with those in the case of the Sendzimir rolling.

However, it is to be noted that even when the number of times of aging increases in the tandem rolling, the magnetic properties do not greatly vary. This shows that the working deformation behavior in the tandem rolling differs from that in the reversing type Sendzimir rolling.

Therefore, when considered from a different way of thinking, this suggests the possibility that the magnetic properties can be improved even by aging only once in the case of the tandem rolling.

Next, experiments as the first step toward this invention will be explained.

B. Tension effect in aging treatment

After a part of the steel sheet having undergone the above-mentioned intermediate annealing-quenching treatment was rolled to 0.60 mm with the tandem mill, small strips of the steel sheet were sampled therefrom. While a tension of 0, 0.1, 0.2, 0.5, 1.5 or 3.0 kg/mm$^2$ was applied to a small steel strip in a tension-applicable, thermally treating furnace, the steel strip was thermally treated therein at 300° C. for 1 minute. Each of the steel strips thus treated was rolled to a final thickness of 0.23 mm by the tandem mill.

Then, the steel strip was subjected to decarburization annealing at 840° C for 2 minutes in wet hydrogen, and an annealing separator consisting mainly of MgO was applied thereto, followed by final annealing. The magnetic properties of the products are shown in Table 2.

TABLE 2

| Magnetic properties | Tension (kg/mm$^2$): 0 | 0.1 | 0.2 | 0.5 | 1.5 | 3.0 |
|---|---|---|---|---|---|---|
| $B_8$ (T) | 1.875 | 1.889 | 1.929 | 1.938 | 1.946 | 1.947 |
| $B_{17/50}$ (W/kg) | 1.18 | 1.12 | 0.96 | 0.93 | 0.91 | 0.89 |

The results in FIG. 2 reveal that when aging was effected under application of tension, the magnetic properties were greatly improved. In particular, it is seen that when aging was effected under application of tension of not less than 0.2 kg/mm$^2$, more excellent magnetic properties were obtained even by the tandem rolling as compared with the Sendzimir rolling.

It is unclear why such a phenomenon occurs. However, it is considered that when C or N is fixed in the dislocation of the steel processed in the course of the deformation behavior peculiar to the tandem rolling, the fixing anisotropy of N or C appears due to the tension to vary the subsequent deformation behavior of steel.

Next, experiments taken as a basis for determining aging conditions in the present invention will be explained.

C. Examination of the optimum draft in the aging treatment

After a part of the steel strip having undergone the above-mentioned intermediate annealing-quenching treatment was rolled at a draft ranging from 5 to 80% by the tandem mill, the steel strip was aged at 250° C. for 3 minutes under application of tension of 0.5 kg/mm$^2$, and subsequently finished to a final thickness of 0.23 mm by the Sendzimir mill.

D. Examination of the optimum temperature in aging

After a part of the steel strip having undergone the above-mentioned intermediate annealing-quenching treatment was rolled to 0.60 mm (draft: 60%) by the tandem mill, the steel strip was thermally treated in a temperature range of 100° C. to 500° C. for 60 seconds under application of tension of 1.5 kg/mm$^2$, and subsequently finished to a final thickness of 0.23 mm by the tandem mill.

E. Examination of the optimum time in aging

After a part of the steel strip was rolled to 0.50 mm (draft: 67%) by the tandem mill, the steel strip was thermally treated at 350° C. for a time of 3 seconds to 1 hour under application of tension of 0.3 kg/mm$^2$, and finished to a final thickness of 0.23 mm by the tandem mill.

Thereafter, after the final rolled sheet was subjected to decarburization annealing at 840° C. for 2 minutes in wet hydrogen, the sheet was coated with the annealing separator consisting mainly of MgO, and finally annealed.

The magnetic properties of the steel sheets thus obtained were examined, and results are shown in Tables 3 to 5.

TABLE 3

| Magnetic properties | Draft (%) when aging was effected | | | | | |
|---|---|---|---|---|---|---|
| | 5 | 20 | 35 | 55 | 70 | 80 |
| $B_8$ (T) | 1.796 | 1.856 | 1.942 | 1.936 | 1.932 | 1.853 |
| $B_{17/50}$ (W/kg) | 1.47 | 1.30 | 0.92 | 0.95 | 0.93 | 1.21 |

TABLE 4

| Magnetic properties | Aging temperature (°C.) | | | | | |
|---|---|---|---|---|---|---|
| | 100 | 150 | 200 | 300 | 400 | 500 |
| $B_8$ (T) | 1.837 | 1.844 | 1.932 | 1.945 | 1.934 | 1.865 |
| $B_{17/50}$ (W/kg) | 1.28 | 1.24 | 0.92 | 0.90 | 0.93 | 1.23 |

TABLE 5

| Magnetic properties | Aging time | | | | | | |
|---|---|---|---|---|---|---|---|
| | 3 sec | 10 sec | 30 sec | 1 min | 10 min | 30 min | 60 min |
| $B_8$ (T) | 1.837 | 1.928 | 1.934 | 1.943 | 1.940 | 1.892 | 1.854 |
| $B_{17/50}$ (W/kg) | 1.26 | 0.95 | 0.93 | 0.92 | 0.95 | 1.13 | 1.28 |

It is seen from the results in Tables 3 through 5 that the optimum aging conditions in the present invention are the temperature range of 200 to 400° C. narrower than the conventional temperature range and a relatively short time period of 10 seconds to 10 minutes, and that fully good magnetic properties can be obtained even by aging only once. Further, it is seen that the steel sheet needs to be rolled at the draft of 35 to 70% in the tandem rolling before the aging treatment.

The above-mentioned effects are also recognized in the grain oriented steel sheets using MnS and/or MnSe as the main inhibitor. In this case, the aging conditions are the same as those in the case of using AlN as the main inhibitor. It is confirmed that the optimum draft range in the tandem rolling before the aging treatment is preferably set at a relatively low level of 30 to 50%.

As mentioned above, the grain oriented steel sheets having excellent magnetic properties can be obtained. However, variations in the magnetic properties occurred in a rare case in the longitudinal direction of the steel sheet in the above production process.

The history of how to clarify this problem will be explained below.

A raw material for the grain oriented steel sheet having a composition of 0.062% of C., 3.15% of Si, 0.080% of Mn, 0.005% of P, 0.026% of S, 0.024% of sol Al, 0.0085% of N ,0.08% of Cu, and the balance being substantially Fe was continuously cast, reheated at high temperatures, and hot rolled to a thickness of 2.2 mm. Then, the hot band was annealed at 1,100° C. for 1 minute, and subsequently quenched to room temperature to precipitate AlN. On the way, the hot band was subjected to interpass thermal treatment, cold rolling, decarburization, and finish annealing in a laboratory.

Then, influences of these treatments upon the magnetic properties were examined.

FIG. 1 shows the relationship between the interpass heat treating temperature and the magnetic flux density $B_8$ when the steel sheets were subjected to cold rolling at a draft of 35%, subsequent one time interpass heat treatment (applied tension: 0.5 kg/mm$^2$) at various temperatures, and cold rolling to a thickness of 0.30 mm. In FIG. 1, marks L, M and T correspond to samples taken out from the steel sheets at tips, centers and rear ends, respectively.

As obvious from FIG. 1, although the magnetic flux density was improved by effecting the interpass heat treatment, it may happen that the optimum interpass heat treatment temperature varies in the longitudinal direction even in the same coil.

In this case, it is considered difficult to assure stable magnetic properties over the entire length of the coil in the one time interpass treatment at a constant temperature.

Through repeated examination of causes giving rise to variations in the optimum temperature, it was clarified that the size of the crystalline grains and the content of C before the cold rolling vary in the longitudinal direction of the coil. The reasons are considered as follows: Since decarburization is effected by self annealing following coiling of the hot band, the decarburized amount differs between the outer portion and the inner portion of the coil at that time because of different cooled states thereof, and since the time required from the rough rolling to the finish rolling in the hot rolling step differs between the tip and the rear end of the coil, the crystalline grain size in the succeeding step is influenced by the difference in recrystallizing behavior during the hot rolling. Thus, it is considered that the optimum heat treating temperature varies in the longitudinal direction of the coil owing to a combination of these factors.

Next, methods of eliminating the difference in the optimum thermally treating temperature in the coil were examined.

Influences of the draft during the intermediate cold rolling before the interpass heat treatment upon variations in the optimum heat treating temperature within the coil were examined, and results are shown in FIG. 2.

As is clear from FIG. 2, it was clarified that although the variation decreases with increase in the draft, when the draft exceeds 70%, the magnetic properties are conspicuously deteriorated, and the variations in the temperature cannot completely be eliminated. Further, although a method with the heat treating time varied has been examined, differences in the treating times become inappropriate on the industrial scale.

It was concluded that in order to assure the magnetic properties in the longitudinal direction of the coil by one time heat treatment, a method of varying the heat treating temperature in the longitudinal direction of the coil is the best method.

The present inventors have investigated concrete means for effecting the thermal treatment.

As a result, it was clarified that although heating could be effected by using an ordinary electric heater or a gas combustion type heating furnace, response to decreasing and elevating of the temperature is so poor that it is fairly difficult to vary the temperature in synchronization with the coil at the actual coil-passing speed. Further, although an infrared heater was suitable for assuring the steel sheet-passing speed, it has a problem in that the equipment is costly. With respect to this, since the temperature of the hot blast furnace can be controlled depending upon the amount of the hot blast blown, this furnace can be said to be suitable for the heating system in this invention. In this case, when the blown amount of the hot blast is continuously adjusted for each of plural zones, the heat treatment can be effected at temperatures made different in the longitudinal direction in synchronization with the coil depending upon the locations of the coil passed.

Next, favorable compositions of the raw material for the grain oriented silicon steel sheets according to the present invention will be explained.

If Si is too small, good iron loss property cannot be obtained due to reduced electric resistance. On the other hand, if it is too much, the cold rolling becomes difficult. Thus, Si is preferably in a range of 2.5 to 4.0%.

The kind of a component to be incorporated as the inhibitor slightly differs depending upon whether it contains Al or not as the main component.

When no Al is contained, to decrease the amount of the component to as small as possible is magnetically preferred because Al is an unnecessary component, and not more than 0.005% of Al is desired. As to N, to decrease it is preferred. However, since it takes a great labor to decrease N and N is an element slightly effective for aging, N is preferably in a range of 0.001 to 0.005%. At that time, MnS and/or MnSe is mainly cited as the inhibitor. The favorable amount of S or Se for finely precipitating MnS or MnSe is around 0.01 to 0.04% when employed singly or in combination. Although Mn is necessary as an inhibitor component as mentioned above, too much Mn makes solid solution treatment impossible. Thus, Mn is preferably in a range of 0.05 to 0.15%.

On the other hand, when Al is contained, N needs to be added in an amount not less than a given level, because Al and N play an important role as the inhibitor. However, if N is too much, it becomes difficult to effect the fine precipitation. Thus, it is preferable that $0.01 \leqq Al \leqq 0.15\%$ and $0.0030 \leqq N \leqq 0.020\%$.

In this case, S, Se may be incorporated as an inhibitor-forming element.

Besides the above elements, an inhibitor-reinforcing element such as Sb, Cu, Sn, B or Ge may further appropriately be added to improve the magnetic properties. The addition amount thereof may be in a known range. In order to prevent surface defects caused by hot brittleness, it is preferable to add Mo in a range of $0.005 \leqq Mo \leqq$; 0.020%.

As the process for producing the raw steel material, a known production process may be employed. An ingot or slab produced is cleaned and worked in a given shape, if necessary, and cut in a uniform size. Then, it is heated and hot rolled. The hot rolled steel strip is cold rolled once, or cold rolled twice bridging an intermediate annealing, thereby attaining a final thickness.

At that time, the draft in the tandem rolling before the aging treatment is 30 to 50% in the case of no Al being contained and 35 to 70% in the case of Al being contained. It is considered that the reason why the favorable range differs between these cases is that the solid solved amount of C differs between them. If the draft in the tandem rolling before the aging treatment falls outside the above range, no sufficient aging effect can be obtained. The aging treatment in the temperature range of 200° to 400° C. for a short time period of 10 seconds to 10 minutes is advantageous because the continuous heat treatment is better from the standpoint of uniformity of the steel strip in the longitudinal direction after the aging and also from the standpoint of application of tension. When the aging time and temperature fall outside the above respective ranges, the aging effect becomes smaller and good effects cannot be obtained.

To impart tension to the steel strip during the aging treatment is the most important point in the present invention. That is, when the tension is given to the steel strip during the aging treatment, not only defects in the rolling structure induced by the tandem rolling is removed, but also far more improved effects can be obtained as compared with the conventional reversing type rolling. This is not a phenomenon expected in the conventional theory. Probably, it is considered that this is caused by the phenomenon that the behavior of fixing C or N to the dislocation comes to exhibit anisotropy in the tension direction. This phenomenon has been completely and newly discovered by the present inventors.

At that time, when the tension imparted is less than 0.2 $kg/mm^2$, sufficient effects cannot be obtained. Therefore, it is necessary that the tension imparted is not less than 0.2 $k9/mm^2$ (preferably 10 $kg/mm^2$).

In the present invention, the tension should be substantially imparted in the state that the steel strip is at high temperatures. In the case of the ordinary continuously annealing furnace, the tension is imparted by dancer rolls arranged in an inlet port or an outlet port of the furnace. However, any known technique such as a technique of utilizing the self-weight of the steel strip to impart tension as in a floating furnace may be appropriately adopted.

After the aging treatment, the steel strip is continuously rolled to attain the final thickness. This rolling may be effected by tandem rolling or the conventional reversing rolling.

The draft in the final rolling step is preferably 55% to 75% in the case of no Al being contained and preferably 80 to 95% in the case of Al being contained. When Al is contained, it is desirable that cooling in the annealing before the final rolling is effected by the conventional quenching. In each case, the present invention is characterized in that aging is effected for a short time on the midway of the final rolling, and that the rolling before aging is effected by the tandem mill with a plurality of the stands.

The present invention is greatly different from the conventional techniques in that such an aging treatment is sufficiently effected only once.

The rolled steel sheet is decarburization annealed by a conventional technique, and after the steel sheet is coated with the annealing separator consisting mainly of MgO, it is coiled and subjected to the final finish annealing. Then, if necessary, the finished steel sheet is coated with an insulating coating. Needless to say, the steel sheet may be subjected to the magnetic domain-dividing treatment by laser, plasma, electron beam or other technique.

Incidentally, the hot band is ordinarily coiled in a range of 500° to 800° C., and decarburization occurs due to self-annealing at that time. If the cooled state of the coil differs between the inner and outer sides thereof, the content of C varies in the longitudinal direction of the hot band. Although this phenomenon depends upon the weight of the coil and the coiling temperature, the content of C becomes non-uniform for 1 to 2 tons at each of the preceding and rear end portions of the coil. Therefore, in that case, when the coil is passed through the heat treating furnace, the heat treating temperature is desirably continuously varied to optimum temperatures for at least the 2-ton area in the preceding end portion (L), the central portion (M), and the central portion and the 2-ton area (T) in the rear end portion, respectively.

The optimum temperatures of the above portions in the longitudinal direction are influenced by the components of the raw material, the behavior of crystals during the hot rolling, and the decarburized amount of the hot band after coiling, but generally falls in the following ranges.

$$250^\circ\ C. \leqq T_L \leqq 400^\circ\ C.$$

$$(T_L-50)^\circ\ C. \leqq T_M \leqq (T_L-50)^\circ\ C.$$

$$(T_L-50)^\circ\ C. \leqq T_T \leqq (T_L=20)^\circ\ C.$$

BEST MODE FOR WORKING THE INVENTION

EXAMPLE 1

Figure 1:
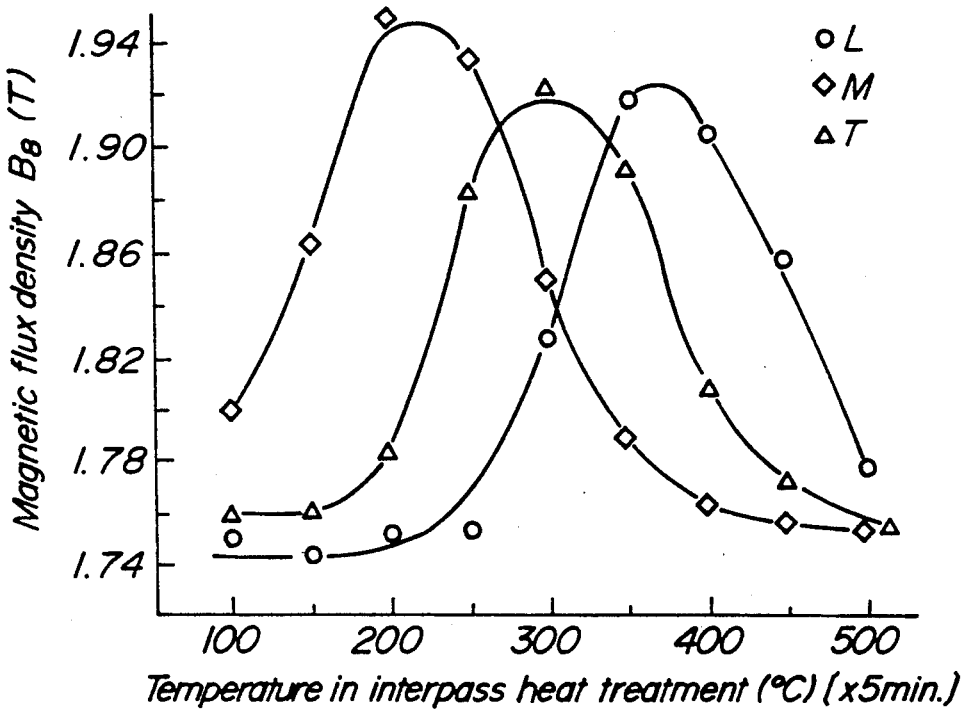
FIG. 1 is a graph showing the influence of the interpass heat treatment temperature upon the magnetic property.
Figure 2:
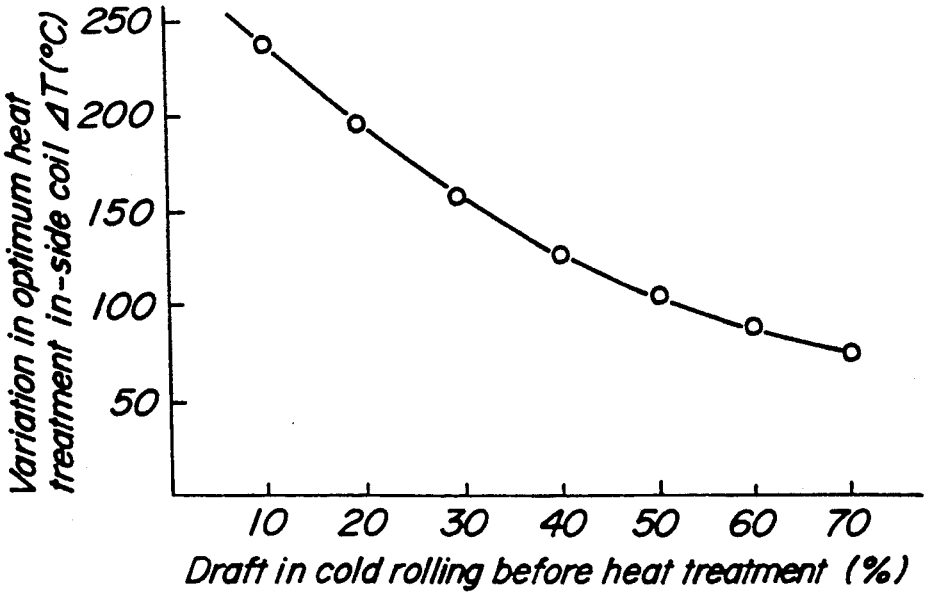
FIG. 2 is a graph showing the relationship between the draft in the intermediate cold rolling before the interpass heat treatment and the variations in the optimum heat treating temperatures inside the coil.

A raw material for grain oriented steel sheet consisting essentially of 0.060% of C, 3.25% of Si, 0.075% of Mn, 0.009% of P, 0.009% of S, 0.025% of sol Al, 0.020% of Se, 0.025% of Sb, 0.06% of Cu, 0.013% of Mo, 0.008% of N and the balance being substantially Fe was melted, was converted in to a slab by continuous casting. After heating the slab at 1450° C. for 10 minutes, it was converted to a hot rolled coil having a thickness of 2.7 mm by ordinary hot rolling. Further, after the hot rolled coil was annealed at 1,000° C. for 1 minute, and pickled, it was rolled to an intermediate thickness of 1.50 mm. After the annealing was effected at 1,100° C. for 2 minutes, the intermediate sheet was rolled to 0.6 mm by the tandem mill with three stands. Thereafter, the cold rolled sheet was aged at 350° C. for 2 minutes in the continuous furnace under application of tension of 0.5 kg/m$^2$, and then the aged sheet was subjected to the reversing rolling by means of Sendzimir mill to attain a final thickness of 0.23 mm.

Thereafter, after the cold rolled sheet was decarburization annealed at 840° C for 2 minutes in wet hydrogen, the sheet was coated with MgO containing 5% of $TiO_2$, and finally finish annealed at 1,200° C. for 10 hours.

The magnetic properties of the thus obtained steel sheet are shown below.

$B_8$: 1.945 T, $W_{17/50}$: 0.82 W/kg

EXAMPLE 2

A slab having a composition shown in Table 6 was converted to a hot band having a thickness of 2.2 mm in the same manner as in Example 1. After pickling, the hot band was cold rolled to the thickness of 1.6 mm. Then, after one minute intermediate annealing for 1,050° C. for one minute), the annealed sheet was quenched. Next, the steel sheet was rolled to an intermediate thickness of 0.80 mm by the tandem mill with four stands. Thereafter, the rolled sheet was divided in half.

One of the divided cold rolled sheets was aged in the continuous furnace at 250° C. for 5 minutes under application of tension of 1.5 kg/mm$^2$, and rolled to a final thickness of 0.20 mm with use of the above tandem mill (Acceptable Example).

The remaining one was aged at 250° C. for 5 minutes in the continuous furnace under application of tension of 0.1 kg/mm$^2$, and rolled to a final thickness of 0.20 mm by using the same tandem mill (Comparative Example).

Next, both of the steel sheets were subjected to decarburization annealing at 840° C. for 2 minutes in wet hydrogen. Then, the cold rolled sheet was coated with MgO containing 7% of $TiO_2$, followed by final finish annealing at 1,200° C. for 10 hours.

The magnetic properties of the thus obtained steel sheets were examined, and results are shown in Table 6.

TABLE 6(a)

| | Composition (%) | | | | | | | | | | | | | Tension | $B_8$ | $W_{17/50}$ | |
|---|---|---|---|---|---|---|---|---|---|---|---|---|---|---|---|---|---|
| No. | C | Si | Mn | P | S | Se | sol Al | Sb | Sn | Cu | Mo | Ge | N | (kg/mm$^2$) | (T) | (W/kg) | Remarks |
| 1 | 0.065 | 3.20 | 0.077 | 0.003 | 0.021 | trace | 0.027 | trace | 0.08 | 0.10 | trace | trace | 0.008 | 1.5 | 1.925 | 0.87 | Acceptable Example |
| | | | | | | | | | | | | | | 0.1 | 1.876 | 1.07 | Comparative |

TABLE 6(a)-continued

| No. | Composition (%) C | Si | Mn | P | S | Se | sol Al | Sb | Sn | Cu | Mo | Ge | N | Tension (kg/mm²) | $B_8$ (T) | $W_{17/50}$ (W/kg) | Remarks |
|---|---|---|---|---|---|---|---|---|---|---|---|---|---|---|---|---|---|
| II | 0.069 | 3.15 | 0.080 | 0.009 | 0.009 | 0.020 | 0.023 | 0.027 | 0.02 | 0.04 | trace | 0.03 | 0.008 | 1.5 | 1.942 | 0.86 | Acceptable Example |
| | | | | | | | | | | | | | | 0.1 | 1.883 | 1.08 | Comparative Example |
| III | 0.059 | 3.15 | 0.072 | 0.008 | 0.003 | trace | 0.025 | 0.025 | 0.02 | 0.03 | 0.012 | trace | 0.008 | 1.5 | 1.936 | 0.88 | Acceptable Example |
| | | | | | | | | | | | | | | 0.1 | 1.880 | 1.09 | Comparative Example |
| IV | 0.064 | 3.24 | 0.075 | 0.015 | 0.002 | trace | 0.026 | 0.025 | 0.02 | 0.03 | trace | trace | 0.008 | 1.5 | 1.927 | 0.89 | Acceptable Example |
| | | | | | | | | | | | | | | 0.1 | 1.864 | 1.12 | Comparative Example |

TABLE 6(b)

| No. | Composition (%) C | Si | Mn | P | S | Se | sol Al | Sb | Sn | Cu | Mo | Ge | N | Tension (kg/mm²) | $B_8$ (T) | $W_{17/50}$ (W/kg) | Remarks |
|---|---|---|---|---|---|---|---|---|---|---|---|---|---|---|---|---|---|
| V | 0.065 | 3.20 | 0.073 | 0.004 | 0.009 | 0.024 | 0.027 | 0.032 | 0.08 | 0.10 | 0.013 | trace | 0.008 | 1.5 | 1.936 | 0.87 | Acceptable Example |
| | | | | | | | | | | | | | | 0.1 | 1.887 | 1.06 | Comparative Example |
| VI | 0.067 | 3.22 | 0.072 | 0.005 | 0.006 | 0.023 | 0.025 | trace | 0.02 | 0.05 | trace | 0.04 | 0.008 | 1.5 | 1.937 | 0.86 | Acceptable Example |
| | | | | | | | | | | | | | | 0.1 | 1.885 | 1.05 | Comparative Example |
| VII | 0.066 | 3.19 | 0.075 | 0.006 | 0.022 | trace | 0.024 | trace | 0.02 | 0.03 | trace | 0.04 | 0.008 | 1.5 | 1.927 | 0.85 | Acceptable Example |
| | | | | | | | | | | | | | | 0.1 | 1.877 | 1.09 | Comparative Example |
| VIII | 0.064 | 3.15 | 0.078 | 0.008 | 0.023 | trace | 0.025 | trace | 0.02 | 0.02 | trace | trace | 0.008 | 1.5 | 1.927 | 0.89 | Acceptable Example |
| | | | | | | | | | | | | | | 0.1 | 1.882 | 1.09 | Comparative Example |

EXAMPLE 3

A slab having a composition given in Table 7 was converted to a 2.2 mm thick hot band in the same manner as in Example 1. After pickling, the hot band was cold rolled to a thickness of 0.65 mm. Then, after the intermediate annealing at 1000° C for one minute, the cold rolled sheet was rolled to an intermediate thickness of 0.35 mm by using the tandem mill with 5 stands. The sheet was divided into two parts.

One of the divided cold rolled sheets was aged at 300° C. for 2 minutes in the continuous furnace under application of tension of 0.3 kg/mm², and subsequently finished to a final thickness of 0.23 mm by the Sendzimir mill as Acceptable Example.

The remainder was aged at 300° C. for 2 minutes in the continuous furnace under application of tension of 0.05 kg/mm², and finished to a final thickness of 0.23 mm by the same Sendzimir mill as Comparative Example.

Then, after each part was subjected to decarburization annealing at 840° C. for 2 minutes in wet hydrogen, it was coated with MgO, and finally finish annealed at 1,200° C. for 5 hours.

The magnetic properties of the thus obtained steel sheets were examined, and results are given in Table 7.

TABLE 7

| No. | Composition (%) C | Si | Mn | P | S | Se | sol Al | Sb | Sn | Cu | Mo | N | Tension (kg/mm²) | $B_8$ (T) | $W_{17/50}$ (W/kg) | Remarks |
|---|---|---|---|---|---|---|---|---|---|---|---|---|---|---|---|---|
| IX | 0.045 | 3.35 | 0.067 | 0.004 | 0.007 | 0.020 | 0.002 | 0.020 | 0.01 | 0.01 | 0.012 | 0.0025 | 0.3 | 1.915 | 0.79 | Acceptable Example |
| | | | | | | | | | | | | | 0.05 | 1.895 | 0.88 | Comparative Example |
| X | 0.040 | 3.32 | 0.072 | 0.008 | 0.025 | trace | 0.003 | trace | 0.05 | 0.01 | trace | 0.0030 | 0.3 | 1.913 | 0.83 | Acceptable Example |

TABLE 7-continued

| No. | Composition (%) C | Si | Mn | P | S | Se | sol Al | Sb | Sn | Cu | Mo | N | Tension (kg/mm²) | $B_8$ (T) | $W_{17/50}$ (W/kg) | Remarks |
|---|---|---|---|---|---|---|---|---|---|---|---|---|---|---|---|---|
| | | | | | | | | | | | | | 0.05 | 1.877 | 0.95 | Comparative Example |
| XI | 0.038 | 3.36 | 0.069 | 0.010 | 0.009 | 0.021 | 0.005 | trace | 0.02 | 0.02 | trace | 0.0027 | 0.3 | 1.910 | 0.85 | Acceptable Example |
| | | | | | | | | | | | | | 0.05 | 1.883 | 0.93 | Comparative Example |
| XII | 0.043 | 3.30 | 0.073 | 0.015 | 0.022 | trace | 0.004 | trace | 0.01 | 0.10 | trace | 0.0035 | 0.3 | 1.917 | 0.82 | Acceptable Example |
| | | | | | | | | | | | | | 0.05 | 1.885 | 0.94 | Comparative Example |
| XIII | 0.040 | 3.31 | 0.074 | 0.011 | 0.002 | 0.020 | 0.002 | 0.022 | 0.02 | 0.06 | trace | 0.0033 | 0.3 | 1.918 | 0.83 | Acceptable Example |
| | | | | | | | | | | | | | 0.05 | 1.884 | 0.93 | Comparative Example |
| XIV | 0.039 | 3.25 | 0.068 | 0.005 | 0.003 | 0.020 | 0.001 | 0.021 | 0.02 | 0.01 | trace | 0.0030 | 0.3 | 1.914 | 0.80 | Acceptable Example |
| | | | | | | | | | | | | | 0.05 | 1.893 | 0.89 | Comparative Example |

EXAMPLE 4

A raw material for grain oriented steel sheet consisting essentially of 0.040% of C, 3.42% of Si, 0.068% of Mn, 0.002% of P, 0.02% of S, 0.022% of Se, 0.026% of Sb, 0.011% of Mo and the balance being substantially Fe was melted, which was continuously cast to obtain a slab. After heating the slab at a high temperature of 1,450° C. for a short time of 15 minutes, the slab was ordinarily hot rolled to obtain a hot rolled coil having a thickness of 2.0 mm. The coiling temperature was 650° C., and the weight of the coil was 20 tons. When the slab was coiled, slight variations in the quality of the coil occurred in the longitudinal direction.

Further, after the hot band was annealed at 1,000° C. for 1 minute and cold rolled once at a draft of 70%, the cold rolled sheet was intermediately annealed at 950° C. for 1 minute, gradually cooled to 800° C. and then quenched to 250° C. Then, the cold rolled sheet was tandem rolled at a draft of 35%, and subjected to interpass heat treatment in a hot blast type aging furnace for 3 minutes under conditions shown in Table 8. The tension applied at that time was 0.5 kg/mm².

Next, the aged sheet was finished to a final thickness of 0.23 mm, and subjected to decarburization and primary recrystallization annealing at 820° C. for minutes. Then, the steel sheet was coated with the annealing separator consisting mainly of MgO, and finally finish annealed at 1,200° C. The magnetic properties of the thus obtained products in the longitudinal direction were examined, and results are given in Table 8.

In Table 8, 1 ton of the preceding end portion, 1 ton of the rear end portion and the remainder are given as "tip", "rear end", and "center", respectively.

TABLE 8

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| 1 | tip | 400 | 1.920 | 0.86 | Acceptable Example |
| | center | 300 | 1.922 | 0.87 | |
| | rear end | 350 | 1.919 | 0.87 | |
| 2 | tip | 300 | 1.877 | 0.98 | Acceptable Example |
| | center | 300 | 1.921 | 0.86 | |
| | rear end | 300 | 1.889 | 0.93 | |

EXAMPLE 5

A raw material for grain oriented steel sheet consisting essentially of 0.070% of C, 3.28% of Si, 0.074% of Mn, 0.002% of P, 0.002% of S, 0.021% of Se, 0.026% of Sb, 0.026% of sol Al, 0.07% of Cu, 0.0087% of N, 0.012% of Mo and the balance being substantially Fe was melted, and was continuously cast to obtain a slab. After heating the slab at a high temperature of 1,420° C. for a short time of 20 minutes, the slab was ordinarily hot rolled to obtain a hot rolled coil having a thickness of 2.2 mm. The coiling temperature was 50° C., and the weight of the coil was 20 tons. When the slab was coiled, slight variations in the quality of the coil occurred in the longitudinal direction.

Further, after the hot band was cold rolled to a thickness of 1.5 mm and subsequently intermediately annealed at 1,100° C. for 1 minute, the annealed sheet was gradually cooled to 950° C. and then quenched to 200° C. or less. Then, the cold rolled sheet was tandem rolled at a draft of 35%, and subjected to interpass heat treatment in the hot blast type aging furnace for 2 minutes under conditions shown in Table 9. The tension applied at that time was 0.8 kg/mm².

Next, the aged sheet was finished to a final thickness of 0.23 mm, and subjected to decarburization and primary recrystallization annealing at 840° C. for 3 minutes. Then, the steel sheet was coated with the annealing separator consisting mainly of MgO, and finally finish annealed at 1,200° C.

The magnetic properties of the thus obtained products in the longitudinal direction were examined, and results are given in Table 9.

In Table 9, 1 ton of the preceding end portion, ton of the rear end portion and the remainder are given as "tip", "rear end", and "center", respectively.

TABLE 9

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| 1 | tip | 375 | 1.941 | 0.83 | Acceptable Example |
| | center | 300 | 1.942 | 0.84 | |
| | rear end | 325 | 1.938 | 0.86 | |
| 2 | tip | 300 | 1.889 | 1.13 | Acceptable |
| | center | 300 | 1.941 | 0.82 | |

TABLE 9-continued

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| | rear end | 300 | 1.907 | 1.03 | Example |

EXAMPLE 6

A raw material for grain oriented steel sheet consisting essentially of 0.041% of C, 3.35% of Si, 0.070% of Mn, 0.002% of P, 0.002% of S, 0.021% of Se, 0.025% of Sb, 0.012% of Mo and the balance being substantially Fe was melted, and was continuously cast to obtain a slab. After heating the slab at a high temperature of 1,450° C. for a short time of 15 minutes, the slab was ordinarily hot rolled to obtain a hot rolled coil having a thickness of 2.4 mm. The coiling temperature was 650° C., and the unit weight of the coil was 10 tons. When the slab was coiled, great variations in the quality of the coil occurred in the longitudinal direction.

Further, after the hot band was annealed at 1,000° C. for 1 minute, cold rolled at a draft of 70% once, and subsequently intermediately annealed at 950° C. for 1 minute, the annealed sheet was gradually cooled to 800° C. and then quenched to 250° C. Then, the quenched sheet was tandem rolled at a draft of 35%, and subjected to interpass heat treatment in the hot blast type aging furnace for 5 minutes under conditions shown in Table 10. The tension applied at that time was 0.5 kg/mm$^2$.

Next, the aged sheet was finished to a final thickness of 0.23 mm, and subjected to decarburization and primary recrystallization annealing at 820° C. for 2 minutes. Then, the steel sheet was coated with the annealing separator consisting mainly of MgO, and finally finish annealed at 1,200° C.

The magnetic properties of the thus obtained products in the longitudinal direction were examined, and results are given in Table 10.

In Table 10, 1 ton of the preceding end portion, 1 ton of the rear end portion and the remainder are given as "tip", "rear end", and "center", respectively.

TABLE 10

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| 1 | tip | 400 | 1.920 | 0.85 | Acceptable |
| | center | 300 | 1.925 | 0.80 | |
| | rear end | 350 | 1.920 | 0.82 | Example |
| 2 | tip | 350 | 1.892 | 0.94 | Reference |
| | center | 350 | 1.899 | 0.90 | |
| | rear end | 350 | 1.920 | 0.81 | Example |
| 2 | tip | not treated | 1.875 | 0.98 | Comparative |
| | center | not treated | 1.880 | 0.93 | Example |
| | rear end | not treated | 1.869 | 1.01 | |

EXAMPLE 7

A raw material for grain oriented steel sheet consisting essentially of 0.060% of C, 3.21% of Si, 0.072% of Mn, 0.004% of P, 0.002% of S, 0.025% of sol Al, 0.020% of Se, 0.027% of Sb, 0.07% of Cu, 0.013% of Mo, 0.0085% of N, and the balance being substantially Fe was melted, and continuously cast to obtain a slab. After heating the slab at a high temperature of 1,450° C. for a short time of 10 minutes, the slab was ordinarily hot rolled to obtain a hot rolled coil having a thickness of 2.2 mm. The coiling temperature was 500° C., and the weight of the coil was 20 tons. When the hot band was coiled, great variations in the quality of the coil occurred in the longitudinal direction.

Further, after the hot band was annealed at 1,100° C. for 1 minute, the annealed band was gradually cooled to 900° C. and then quenched to 200° C. Then, the quenched band was tandem rolled at a draft of 45%, and subjected to interpass heat treatment in the hot blast type aging furnace for 5 minutes under conditions shown in Table 11. The tension applied at that time was 0.3 kg/mm$^2$.

Next, the aged sheet was finished to a final thickness of 0.30 mm, and subjected to decarburization and primary recrystallization annealing at 840° C. for 3 minutes. Then, the steel sheet was coated with the annealing separator consisting mainly of MgO, and finally finish annealed at 1,200° C. for 10 hours.

The magnetic properties of the thus obtained products in the longitudinal direction were examined, and results are given in Table 11.

In Table 10, 1 ton of the preceding end portion, 1 ton of the rear end portion and the remainder are given as "tip", "rear end", and "center", respectively.

TABLE 11

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| 1 | tip | 350 | 1.955 | 0.98 | Acceptable |
| | center | 250 | 1.958 | 0.99 | |
| | rear end | 300 | 1.946 | 0.98 | Example |
| 2 | tip | 300 | 1.877 | 1.25 | Reference |
| | center | 300 | 1.850 | 1.36 | |
| | rear end | 300 | 1.949 | 0.99 | Example |

EXAMPLE 8

A raw material for grain oriented steel sheet containing 0.064% of C, 3.25% of Si, 0.070% of Mn, 0.003% of P, 0.023% of S, 0.026% of sol Al, 0.0088% of N, 0.07% of Cu, 0.05% of Sn, 0.012% of Mo, and the balance being substantially Fe was converted to a hot band in the same manner as in Example 6 (Coiling temperature: 550° C., unit weight of coil: 20 tons). When the slab was coiled, great variations in the quality of the coil occurred in the longitudinal direction.

Further, after the hot band was cold rolled to 1.4 mm and then intermediately annealed at 1,100° C. for 1 minute, the annealed sheet was gradually cooled to 900° C. and then quenched to 200° C. Then, the quenched band was tandem rolled at a draft of 40%, and subjected to interpass heat treatment for 3 minutes under conditions shown in Table 12 (In this case, "tip", "rear end" and "center"0 are 2 tons in the proceeding end portion, 2 tons in the rear end portion and the central portion, respectively). The tension applied at that time was 0.5 kg/mm$^2$.

Next, the aged sheet was finished to a final thickness of 0.23 mm, and subjected to decarburization and primary recrystallization annealing at 840° C. for minutes. Then, the steel sheet was coated with the annealing separator consisting mainly of MgO, and finally finish annealed at 1,200° C. for 10 hours.

The magnetic properties of the thus obtained products in the longitudinal direction were examined, and results are given in Table 12.

TABLE 12

| Slab No. | Location of hot band | Thermally treating temperature (°C.) | Magnetic flux density $B_8$ (T) | Iron loss $W_{17/50}$ (W/kg) | Remarks |
|---|---|---|---|---|---|
| 1 | tip | 350 | 1.938 | 0.88 | Acceptable Example |
| | center | 275 | 1.936 | 0.85 | |
| | rear end | 325 | 1.936 | 0.85 | |
| 2 | tip | 300 | 1.845 | 1.20 | Reference Example |
| | center | 300 | 1.889 | 1.00 | |
| | rear end | 300 | 1.890 | 1.05 | |

INDUSTRIALLY APPLICABLE FIELD

As mentioned above, according to the present invention, the magnetic properties can be stably improved with increased productivity by effectively combining the tandem rolling with the aging treatment in the final cold rolling step. In particular, since the tandem rolling, which is a highly efficient production process, can be applied to the production of grain oriented silicon steel sheets containing Al, the present invention is extremely useful for the production of grain oriented silicon steel sheets having high magnetic flux and density.

We claim:

1. A process for producing grain oriented silicon steel sheets having excellent magnetic properties, comprising the steps of: hot rolling a raw material for the grain oriented silicon steel; cold rolling the hot band once or twice; the hot band being intermediate annealed in between twice cold rollings and wherein cold rolling is effected at a draft of 30 to 70% by tandem rolling in a final cold rolling step, and the thus produced cold rolled sheet is continuously thermally treated in a temperature range of 200° to 400° C. for 10 seconds to 10 minutes under application of tension of not less than 0.2 kg/mm$^2$, and then continuously cold rolled to attain a final thickness; decarburization annealing the cold rolled sheet; coating the decarburized sheet with an annealing separator; and finish annealing the coated sheet.

2. The process for producing the grain oriented silicon steel sheets having excellent magnetic properties according to claim 1, wherein said hot rolling produces a hot rolled coil and when the hot rolled coil has variations in quality in a longitudinal direction, the continuous heat treating temperature after the tandem rolling is continuously varied depending upon difference in the quality of the coil in the longitudinal direction.

3. The process for producing the grain oriented silicon steel sheets having excellent magnetic properties according to claim 1 or 2, wherein the continuously heat treatment after the tandem rolling is effected by utilizing a hot blast.

4. The process for producing the grain oriented silicon steel sheets having excellent magnetic properties according to claim 1 or 2, wherein the raw material for the grain oriented silicon steel contains AlN as a main inhibitor, and the draft in the tandem rolling is 35 to 70%.

5. The process for producing the grain oriented silicon steel sheets having excellent magnetic properties according to claim 1 or 2, wherein the raw material for the grain oriented silicon steel contains MnS and/or MnSe as a main inhibitor, and the draft in the tandem rolling is 30 to 50%.

* * * * *

UNITED STATES PATENT AND TRADEMARK OFFICE

CERTIFICATE OF CORRECTION

PATENT NO. : 5,181,972

DATED : January 26, 1993

INVENTOR(S) : Michiro Komatsubara et al

It is certified that error appears in the above-identified patent and that said Letters Patent is hereby corrected as shown below:

In Column 1, line 45, please delete "0".

In Column 8, line 50, please change "0.2 k9/$mm^2$" to --0.2 kg/$mm^2$--.

In Column 13, line 48, please add --2-- after "for".

Signed and Sealed this

Second Day of November, 1993

Bruce Lehman

*Attest:*

BRUCE LEHMAN

*Attesting Officer*

*Commissioner of Patents and Trademarks*